US011242716B2

(12) United States Patent
Miller et al.

(10) Patent No.: US 11,242,716 B2
(45) Date of Patent: Feb. 8, 2022

(54) SYSTEM AND METHOD FOR REMOTE OPERATION OF A CLOSED MOUTH POWER TONG TO MAKE UP AND BREAK OUT TUBING ON A WELL SERVICING RIG

(71) Applicant: Ranger Energy Services, LLC, Houston, TX (US)

(72) Inventors: Harold James Miller, Calgary (CA); Ivan Amic, Calgary (CA); Jason Brent Schroeder, Edmonton (CA); Christopher Jason Serran, Calgary (CA)

(73) Assignee: Ranger Energy Services, LLC, Houston, TX (US)

( * ) Notice: Subject to any disclaimer, the term of this patent is extended or adjusted under 35 U.S.C. 154(b) by 5 days.

(21) Appl. No.: 16/716,657

(22) Filed: Dec. 17, 2019

(65) Prior Publication Data

US 2020/0256136 A1 Aug. 13, 2020

Related U.S. Application Data

(60) Provisional application No. 62/781,487, filed on Dec. 18, 2018.

(51) Int. Cl.

| | |
|---|---|
| ***E21B 19/06*** | (2006.01) |
| ***E21B 19/10*** | (2006.01) |
| ***E21B 19/16*** | (2006.01) |

(52) U.S. Cl.

CPC ..... *E21B 19/06* (2013.01); *E21B 19/10* (2013.01); *E21B 19/161* (2013.01); *E21B 19/165* (2013.01)

(58) Field of Classification Search

CPC ..... E21B 19/06; E21B 19/084; E21B 19/10; E21B 19/161; E21B 19/165

See application file for complete search history.

(56) References Cited

U.S. PATENT DOCUMENTS

| | | | | |
|---|---|---|---|---|
| 4,643,399 | A * | 2/1987 | Fletcher | E21B 19/16 254/386 |
| 2003/0221871 | A1* | 12/2003 | Hamilton | E21B 19/168 175/85 |
| 2005/0235780 | A1* | 10/2005 | Dagenais | E21B 19/164 81/57.35 |
| 2007/0074606 | A1* | 4/2007 | Haise | E21B 19/164 81/57.16 |
| 2008/0202813 | A1* | 8/2008 | Anthony | E21B 19/14 175/52 |
| 2012/0212326 | A1* | 8/2012 | Christiansen | G06K 7/10009 340/10.1 |
| 2012/0318517 | A1* | 12/2012 | Christensen | E21B 19/004 166/345 |

(Continued)

*Primary Examiner* — Christopher J Sebesta
(74) *Attorney, Agent, or Firm* — Scott Griggs; Griggs Bergen LLP

(57) ABSTRACT

A system and method for mounting a Closed-Mouth Power Tong on a Well Servicing Rig in order is disclosed. The power tong can be operated remotely when making up or breaking out connections on oilfield tubing. The system utilizes an assembly that can lift and lower the tong to the appropriate height as required to engage the threads on the tubing. The assembly is connected to the blowout preventer or wellhead with a quick connect system that is adjustable for various angles so that the tong can be utilized in various positions to run tubing into, or out from, the well center unhindered.

14 Claims, 17 Drawing Sheets

(56) References Cited

U.S. PATENT DOCUMENTS

| | | | | |
|---|---|---|---|---|
| 2013/0341002 | A1* | 12/2013 | Flusche | E21B 19/155<br>166/77.52 |
| 2014/0124218 | A1* | 5/2014 | Pilgrim | E21B 19/083<br>166/380 |
| 2017/0074049 | A1* | 3/2017 | Roodenburg | B63B 29/02 |

* cited by examiner

SYSTEM AND METHOD FOR REMOTE OPERATION OF A CLOSED MOUTH POWER TONG TO MAKE UP AND BREAK OUT TUBING ON A WELL SERVICING RIG

PRIORITY STATEMENT & CROSS-REFERENCE TO RELATED APPLICATIONS

This application claims the benefit of U.S. Patent Application No. 62/781,487 entitled "System and Method for Remote Operation of a Closed Mouth Power Tong to Make Up and Break Out Tubing on a Well Servicing Rig" filed Dec. 18, 2018, in the names of Harold James Miller et al.; which is hereby incorporated by reference, in entirety, for all purposes.

TECHNICAL FIELD OF THE INVENTION

The present disclosure is related to the field of power tongs for running tubing strings into and out of a well, in particular, systems for remotely operating and positioning power tongs.

BACKGROUND OF THE INVENTION

A typical Well Servicing Rig, as defined herein, can utilize a four-man crew when running a tubing string into a well or pulling it out. The crew can comprise of one rig operator, one derrickman, and two floormen, although the exact number of personnel can vary depending on the well and type of rig used. The rig operator typically operates the controls for hoisting the entire string as well as single or double joint stands. The derrickman typically handles the top end of the stand in the derrick or works on the ground to handle single joints when picking up or laying down. Normally, one floorman handles the bottom end of the stands as they are being picked up or set back, and the second floorman operates a hydraulic power tong to connect or disconnect the threaded joints.

It is, therefore, desirable to provide a system and method that enables the remote operation of a power tong that is safer, easier and less strenuous for personnel to operate on a Well Servicing Rig.

SUMMARY OF THE INVENTION

A system and method for mounting, positioning and remotely operating a power tong is provided. For the purposes of this specification and the claims that follow, the following terms shall be defined as:

TOPS—means a tong operating and positioning system.

Well Servicing Rig—can comprise one or more of a workover rig, a completion rig, a well service rig, a drillout rig, and any other rig used to service an oil and gas well post-drilling operation as well known to those skilled in the art.

Closed-Mouth Power Tong—can comprise one or more of a closed-face tong, a closed-mouth tong, a full circle tong, any tong that is not considered to be "open-faced" by those skilled in the art, and any tong designed to stay on well-center while moving tubulars in or out of a well-hole by those skilled in the art.

Slips—can comprise one or more of hydraulically-operated slips, pneumatically-operated slips (either by air or by other gases), and hand-operated slips, as well known to those skilled in the art.

Tubing String—any tubulars used in conjunction with Well Servicing Rig operations, as well known to those skilled in the art.

The system can be mounted on the wellhead or wellhead equipment to enable the power tong to be centralized on the well when in operation. In some embodiments, the system can comprise a remote-control panel that can allow the equipment to be operated from a remote position. In some embodiments, the remote-control panel can allow the system to be operated by the rig operator. In some embodiments, the system can be operated by another person from a remote position. In some embodiments, the system can comprise controls for all functions locally so that it can be operated locally.

In some embodiments, the remote-controls can be configured to position the tong vertically, engage and disengage the tubing backup, function the tong in forward and reverse, and shift the tong between high and low gear. In addition to the remote tong controls, the remote-control panel can comprise a lockable isolation valve that can allow the equipment to be de-energized prior to working on it.

In some embodiments, the system can comprise a mounting adapter flange that can be bolted to the blowout preventer or other wellhead equipment. The system can be attached to the adapter flange quickly by fitting the base assembly onto the adapter plate and attaching turnbuckles. The system can be rotated to any desired position by rotating the floating load ring to align with the turnbuckles. The base assembly is designed in such a way that wellhead equipment, for example, a tubing stripper, can be installed above the mounting adapter flange if desired.

In some embodiments, the base assembly can comprise a housing that can accept the base of a tong hoisting mast. The hoisting mast can be rotated in the housing in order to swing the tong away from well center when operations require it, and to be swung in line with well center for tubing operations. The tong hoisting mast can raise and lower a trolley that comprises guide rollers that can interface with the mast and a tong attachment mechanism. A tubing tong that can comprise a tubing backup can be attached to the tong attachment mechanism, which can allow the tong to float as the tubing is being threaded together unthreaded, such as the case may be. The tong attachment mechanism can comprise a threaded compensation mechanism that can raise or lower the tong relative to the trolley as a means to fine-tune the vertical position of the tong relative to the trolley.

Method of Operation

In some embodiments, a method for mounting, operating, dismounting and transporting the system can be described as follows.

Installation

In some embodiments, a method of installation can comprise the following steps:

1. Install the mounting adapter flange on top of blowout preventer or wellhead component.
2. Pick up the mounting base configured for transport and set on top of mounting adaptor flange at the desired angle.
3. Rotate the floating load ring to align the connecting tabs with the turnbuckles on the mounting base.
4. Connect turnbuckles on the mounting base to the connecting tabs on the floating load ring and tighten.
5. Lower stabilizing jacks on mounting base.
6. Pick up hoisting mast and insert the base into the housing on the mounting base.
7. Insert mast retaining pin on mast base.

8. Insert pin that connects the tong attachment mechanism on the travelling trolley to the tong.

9. Connect service loop to control panel.

10. Remove retaining pin from the travelling trolley.

11. Remove tong hold down threaded handle and tie down strap.

12. Energize the hydraulic circuit and the control circuit.

13. Raise tong and swing away from hole center.

14. Remove the transport adapter.

15. Remove slips hold down threaded handle.

16. Move slips to hole center and Connect air lines to slips.

17. Swing tong back to hole center and insert retention pin.

Operation—Making Up a Tubing String

In some embodiments, a method to make up a tubing string and run it into a well can comprise the following steps:

1. Lower the tong to a point just above the slips.

2. Lower the tubing through the tong until the elevators are just above the tong.

3. Close the slips.

4. Open the elevators.

5. Raise the elevators to pick up the next joint of tubing.

6. Insert the next joint of tubing into the tubing that is in the well.

7. Vertically align the tong to straddle the tubing connection.

8. Shift the tubing backup control to remote-control.

9. Shift the tong transmission into high gear.

10. Engage the tubing backup.

11. Rotate the tong in the forward direction until it stalls.

12. Shift the tong into low gear.

13. Rotate the tong in the forward direction until proper torque is achieved.

14. Rotate the tong in the reverse direction to release the tong.

15. Disengage the tubing backup.

16. Raise the elevators until the slips can be opened.

17. Open the slips.

18. Repeat previous steps as necessary.

Operation—Breaking Out the Tubing String

In some embodiments, a method for breaking out the tubing string and removing it from the well can comprise the following steps:

1. Lower the tong to a point just above the slips.

2. Lower the elevators to just above the tong.

3. Close the elevators.

4. Raise the elevators.

5. Open the slips.

6. Stop the elevators when the tubing connection is above the tong.

7. Close the slips.

8. Vertically align the tong to straddle the tubing connection.

9. Shift the tubing backup control to remote-control.

10. Shift the tong transmission into low gear.

11. Engage the tubing backup.

12. Rotate the tong in the reverse direction until it rotates freely.

13. Shift the tong into high gear.

14. Rotate the tong in the reverse direction until the connection has been fully disconnected.

15. Rotate the tong in the forward direction to release the tong.

16. Disengage the tubing backup.

17. Raise the elevators until the joint of tubing can be removed.

18. Repeat the previous steps as necessary.

Disassembly

In some embodiments, a method for disassembling the system can comprise the following steps:

1. Raise tong and swing away from hole center.

2. Disconnect air lines to slips.

3. Move slips to transport position.

4. Install slips hold down threaded handle.

5. Install the transport adapter.

6. Swing tong back to hole center and insert retention pin.

7. Lower the tong until it is supported by the transport adapter.

8. De-energize the hydraulic circuit and the control circuit.

9. Install the tong hold down threaded handle and tie down strap.

10. Install the retaining pin in the travelling trolley.

11. Disconnect service loop from control panel.

12. Remove the pin that connects the tong attachment mechanism on the travelling trolley to the tong.

13. Remove the mast retaining pin on mast base.

14. Remove the hoisting mast from the housing on the mounting base.

15. Support the mounting base with a winch.

16. Raise stabilizing jacks on mounting base.

17. Loosen the turnbuckles on the mounting base and disconnect from the connecting tabs on the floating load ring.

18. Pick up the mounting base configured for transport and set on top of trailer or transport truck.

19. The mounting adapter flange on top of blowout preventer or wellhead component may be removed or left in place if the system is going to be used on the next well.

Broadly stated, in some embodiments, a system can be provided for positioning and operating a tong for inserting a tubing string into a wellbore and removing the tubing string from the wellbore, the wellbore comprising a wellhead, the system comprising: a mounting base configured for mounting on the wellhead; a hoisting mast disposed on the mounting base; a trolley disposed on the hoisting mast, the trolley configured to move up and down on the hoisting mast; a tong attachment mechanism disposed on the trolley, the tong attachment mechanism configured to attach the tong to the trolley; and a hoisting mechanism configured for raising and lowering the trolley on the hoisting mast.

Broadly stated, in some embodiments, the system can further comprise a mounting adaptor flange configured for attaching the mounting base to the wellhead.

Broadly stated, in some embodiments, the mounting adaptor flange can be configured for attaching the mounting base to a blow-out preventer disposed on the wellhead.

Broadly stated, in some embodiments, the trolley can comprise a plurality of rollers rotatably disposed within rail channels disposed along the hoisting mast.

Broadly stated, in some embodiments, the tong attachment mechanism can be configured for raising and lowering the tong relative to the trolley when the tong is attached to the tong attachment mechanism.

Broadly stated, in some embodiments, the tong attachment mechanism can comprise a spring-loaded mechanism configured for vertical movement of the tong when the tubing string is being threaded together or unthreaded, and then return the tong to a nominal fixed position.

Broadly stated, in some embodiments, the hoisting mechanism can comprise: a linear actuator comprising a first end thereof operatively attached to the hoisting mast and a second end thereof comprising a pulley; and a cable comprising one end thereof operatively attached to a base of the hoisting mast and a second end thereof operatively attached to the trolley, the cable passing over the pulley, wherein extending or retracting the linear attenuator raises or lowers the pulley therein raising or lowering the trolley.

Broadly stated, in some embodiments, the hoisting mechanism can comprise: a double-ended linear actuator comprising an inner rod comprising one end thereof operatively coupled to a base of the hoisting mast and a second end thereof operatively coupled to an apex of the hoisting mast; and the double-ended linear actuator comprising an outer cylinder disposed around the inner rod, the outer cylinder operatively coupled to the trolley, wherein raising or lower the outer cylinder on the inner rod raises or lowers the trolley.

Broadly stated, in some embodiments, the hoisting mechanism can comprise: a roller chain disposed between an apex and a base of the hoisting mast; a motor disposed on the trolley, the motor comprising a drive sprocket operatively engaged with the roller chain; and at least one idler sprocket disposed on the trolley, the roller chain operatively engaged with the at least one idler sprocket, wherein operating the motor raises or lowers the trolley on the hoisting mast.

Broadly stated, in some embodiments, the hoisting mechanism can comprise: a winch disposed on the trolley or on a base of the hoisting mast; at least one idler pulley disposed at an apex of the hoisting mast; and a cable comprising a first end thereof operatively attached to the trolley and a second end thereof operatively attached to the winch, the cable passing over the at least one idler pulley between the first end and the second end, wherein reeling in or paying out the cable with the winch raises or lowers the trolley on the hoisting mast.

Broadly stated, in some embodiments, the system can further comprise a pivot mechanism configured to move the tong towards and away from a position disposed over the wellbore.

Broadly stated, in some embodiments, the system can further comprise a remote-control panel operatively coupled to the tong, wherein the remote-control panel is configured to transmit control signals to the tong whereby the tong can be operated and positioned from a location remote from the wellbore.

Broadly stated, in some embodiments, the control signals can comprise one or more of pneumatically transmitted control signals, hydraulically transmitted control signals, electrically transmitted control signals and wirelessly transmitted radio control signals.

Broadly stated, in some embodiments, a method is provided for positioning and operating a tong for inserting a tubing string into a wellbore, the wellbore comprising a wellhead, the method comprising the steps of: providing a system as set forth above; mounting the system on the wellhead; lowering a first tubing string through the tong and closing slips to hold the first tubing string in place; inserting a second tubing string into the first tubing string; operating the tong to make up a joint between the first tubing string and the second tubing string; and raising the tubing strings and opening the slips.

Broadly stated, in some embodiments, the method can further comprise the steps of: raising the joint above the tong; closing the slips; aligning the tong with the joint; operating the tong to break the joint between the first tubing string and the second tubing string; and removing the second tubing string from wellbore.

DETAILED DESCRIPTION OF EMBODIMENTS

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etcetera described in one embodiment can also be included in other embodiments but is not necessarily included. Thus, the present technology can include a variety of combinations and/or integrations of the embodiments described herein.

Figure 1:
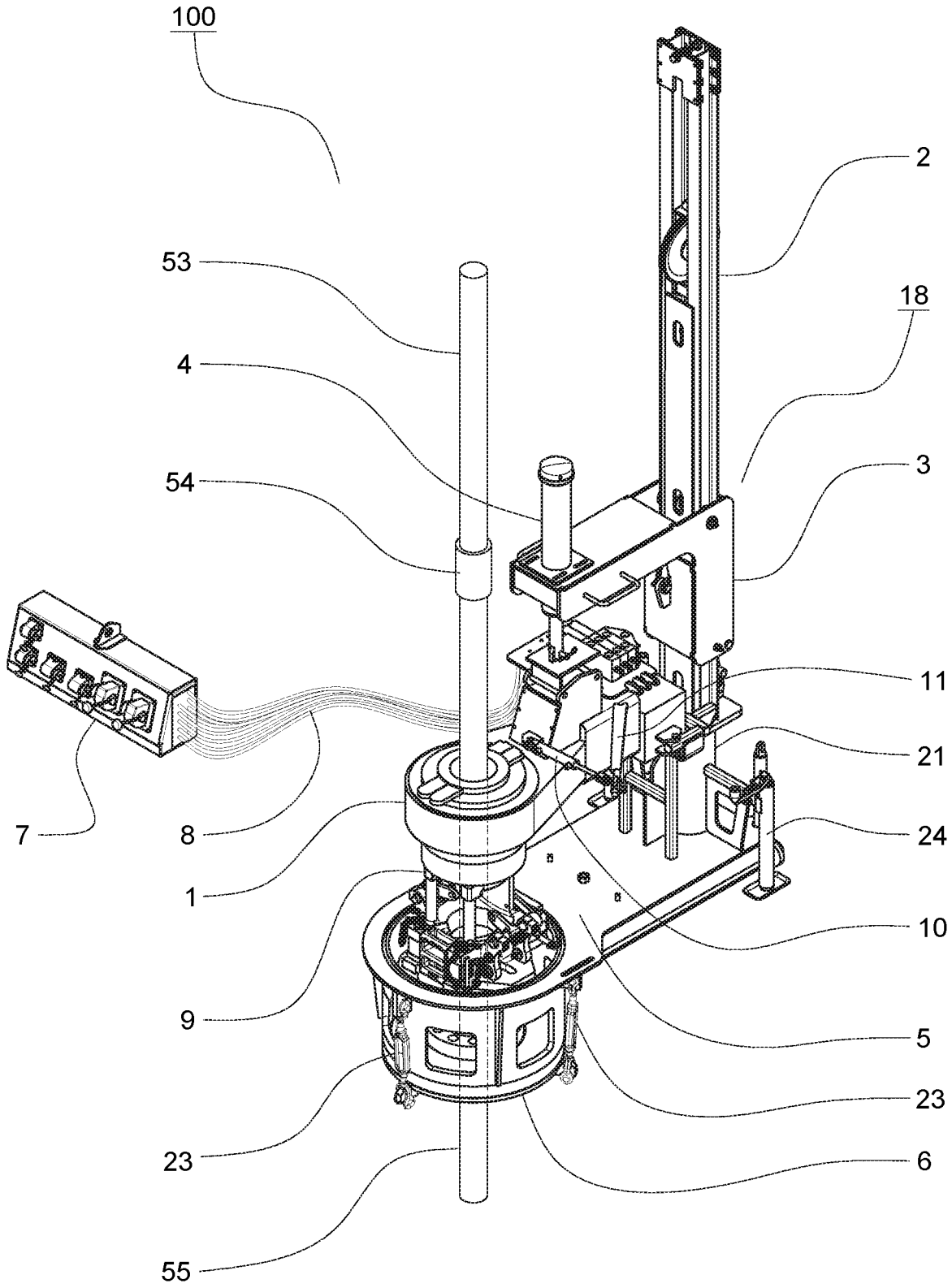
FIG. 1 is an isometric view depicting one embodiment of a tong operating and positioning system ("TOPS").

Referring to FIG. 1, an isometric view of one embodiment of tong operating and positioning system ("TOPS") 100 is shown with a tubing joint made up of upper tubing joint 53 connected to lower tubing joint 55 via tubing coupler 54. In some embodiments, a Closed-Mouth tubing tong (as provided by third party manufacturers as well known to those skilled in the art), designated by reference numeral 1, can be connected to tong attachment mechanism 4 that can be carried by trolley 3. In some embodiments, trolley 3 can comprise rollers that are disposed within a track on hoisting mast 2. Hoisting mast 2 can comprise a mechanism that can be used to raise and lower the trolley 3 and, thus, tong 1 along hoisting mast 2. In some embodiments, hoisting mast 2 can be rotatably connected to mounting base 5 so that it can be in position to hold tong 1 directly over the center of the well, or it can be turned to move tong 1 away to provide direct access to the well. In some embodiments, mounting base 5 can be configured to attach to mounting adapter flange 6 that, in turn, can be bolted to the blowout preventer or wellhead equipment located on the well. In some embodiments, mounting base 5 can be configured to have other equipment, designated as reference numeral 9, attached thereon. Such other equipment can include a tubing stripper or slips as well as other equipment as well known by those skilled in the art. In some embodiments, tong 1 can be controlled remotely from remote-control panel 7 that can communicate with, and control the functions of, tong 1 through service loop 8. In some embodiments, service loop 8 can comprise one or more of pneumatic, hydraulic, electronic and wireless control connections to operate tong 1, depending on the control requirements of tong 1.

Figure 2A:
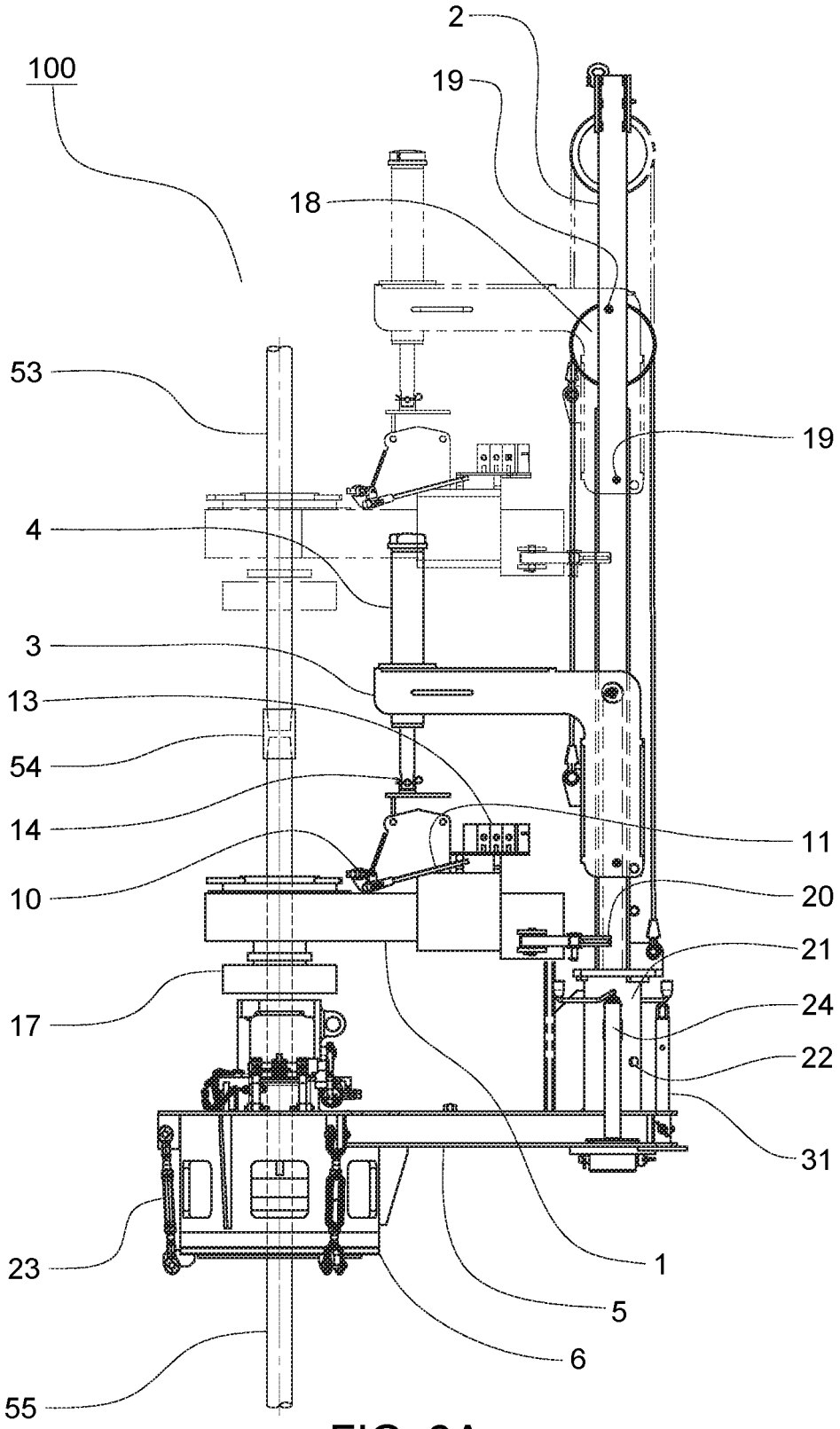
FIG. 2A is a side elevation view depicting the TOPS system of FIG. 1.
Figure 2B:
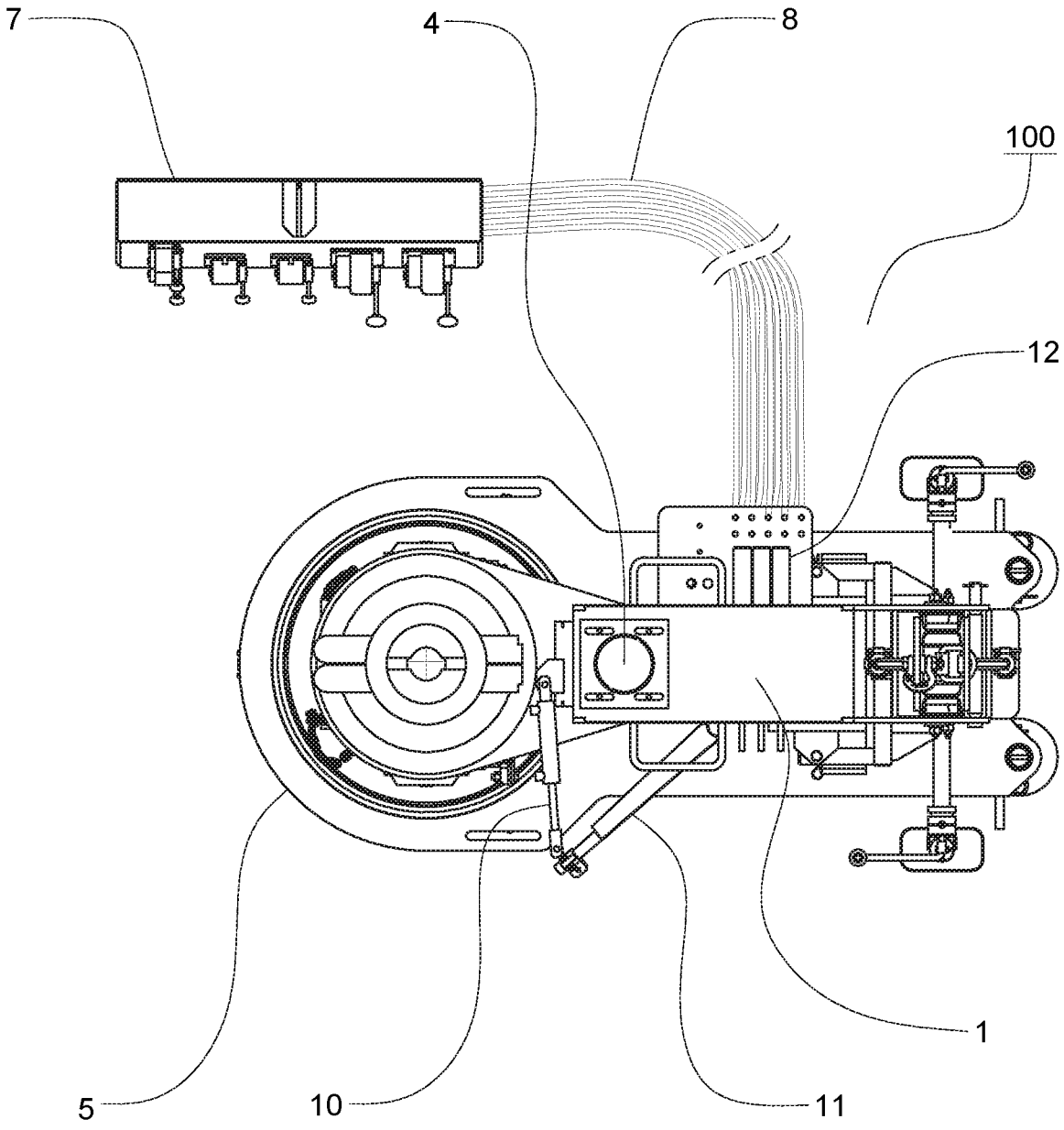
FIG. 2B is a top plan view depicting the TOPS system of FIG. 1.
Figure 2C:
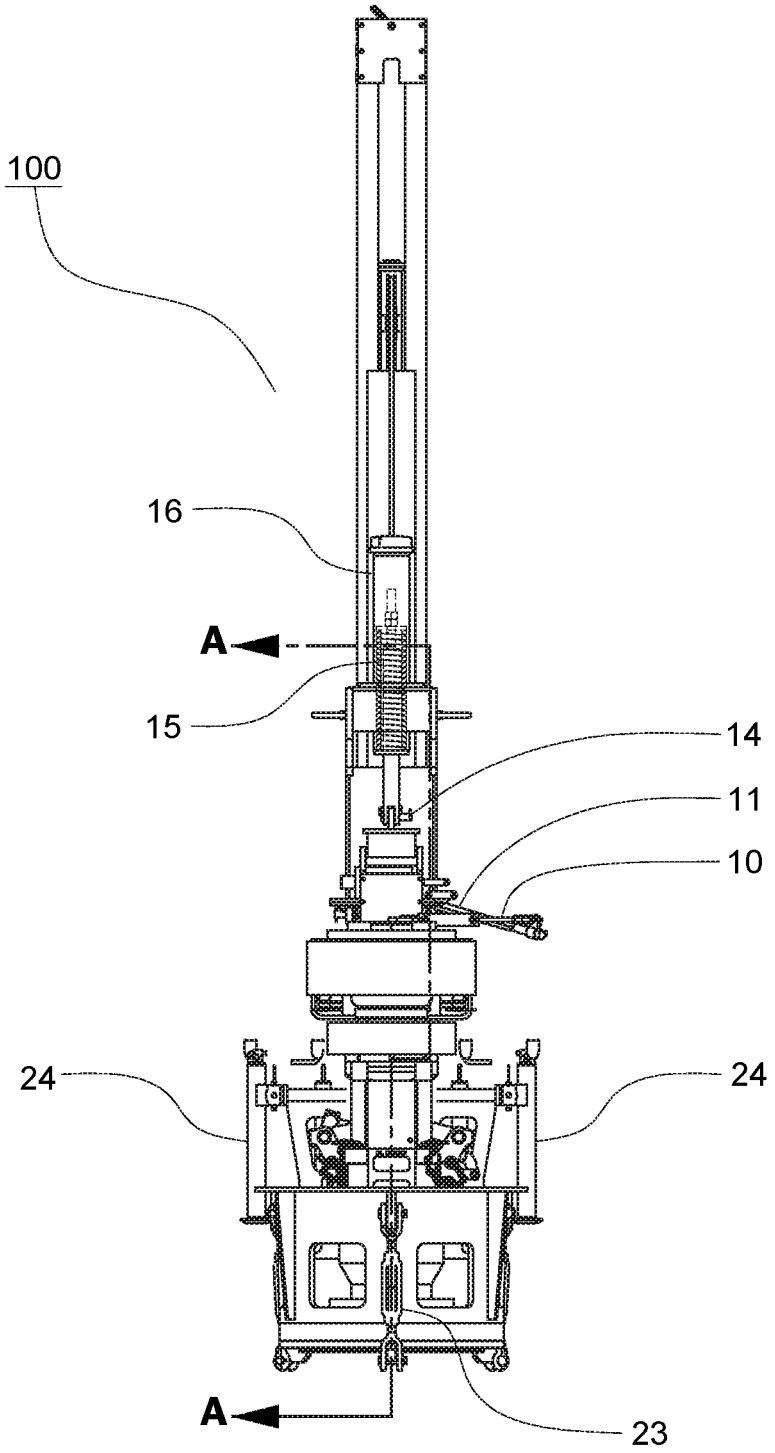
FIG. 2C is a front elevation view depicting the TOPS system of FIG. 1.

FIGS. 2A, 2B and 2C shows side, top and front views, respectively, of one embodiment of TOPS system 100. In the illustrated embodiment, tong 1 can be configured or modified by having actuator 10 attached thereto, wherein actuator 10 can shift a transmission disposed on tong 1 between low and high gear by moving shift lever 11. In some embodiments, TOPS system 100 can comprise actuators 12 operatively coupled to hydraulic controls 13. In some embodiments, the hydraulic controls of tong 1 can be activated manually, or remotely from remote-control panel 7 that can communicate with the actuators through service loop 8. In some embodiments, tong 1 can be connected to tong attachment mechanism 4 with pin 14. In some embodiments, tong attachment mechanism 4 can comprise of spring 15 disposed within housing 16 such that tong attachment mechanism 4 can provide a spring-loaded mechanism that can allow tong 1 to move vertically in relation to integrated backup 17 as tubing is threaded together or unthreaded, and then return tong 1 to a nominal fixed position. In some embodiments, tong attachment mechanism 4 can comprise threaded means for raising or lowering tong 1 relative to trolley 3. In some embodiments, tong attachment mechanism 4 can be mounted to trolley 3 that can move vertically on hoisting mast 2 by hoisting system 18. In some embodiments, trolley 3 can be guided by rollers 19 that are disposed within the rails of hoisting mast 2. In some embodiments, tong can be held in line with hoisting mast 2 with torque guide bracket 20 that can be attached to tong 1 and can protrude past the edges of hoisting mast 2. In some embodiments, TOPS system 100 can comprise a pivot mechanism. In some embodiments, the bottom of hoisting mast 2 can be cylindrical in shape (cylindrical section 34 shown in FIGS. 5A and 5B) and can fit within round housing 21 that can be part of, or integral to, mounting base 5. In some embodiments, hoisting mast 2 can be rotated as desired and held in place at specified increments with pin 22 passing corresponding openings disposed through cylindrical section 34. In some embodiments, mast base 5 can be clamped to mounting adaptor flange 6 and can be further held in place with turnbuckles 23. In some embodiments, mounting base 5 can comprise stabilization jacks 24 to stabilize the mechanism.

Figure 3:
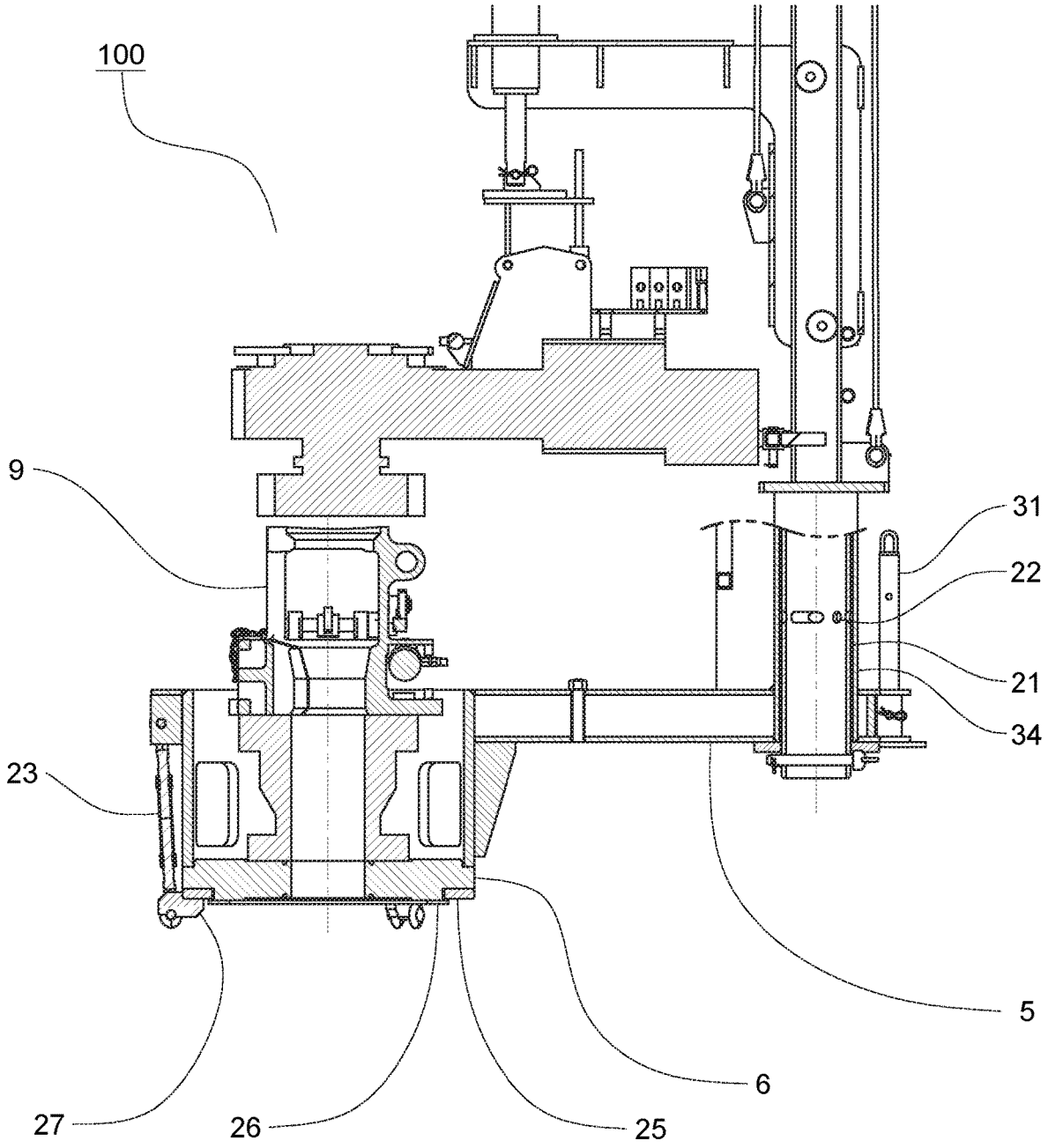
FIG. 3 is a cross-section elevation view depicting the TOPS system of FIG. 2C along section lines A-A.

FIG. 3 shows a section view of one embodiment of mounting base assembly 5 and mounting adaptor flange 6 of TOPS system 100. In some embodiments, mounting adaptor flange 6 can comprise floating load ring 25 that can be held in place by retainer 26. In some embodiments, floating load ring 25 can be rotated in relation to mounting adapter flange 6 in order to align connecting tabs 27 with turnbuckles 23 that are attached to mounting base 5.

Figure 4A:
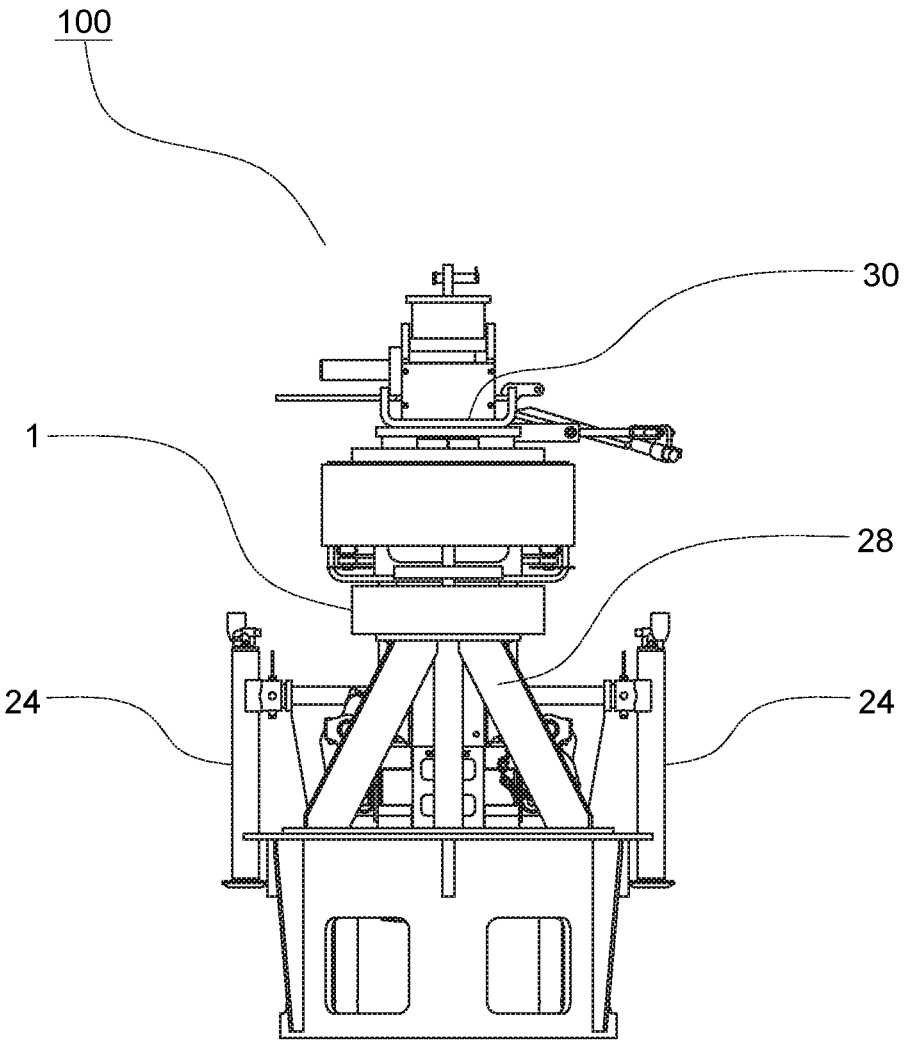
FIG. 4A is a front elevation view depicting the tong and base of the TOPS system of FIG. 1 in transport mode.
Figure 4B:
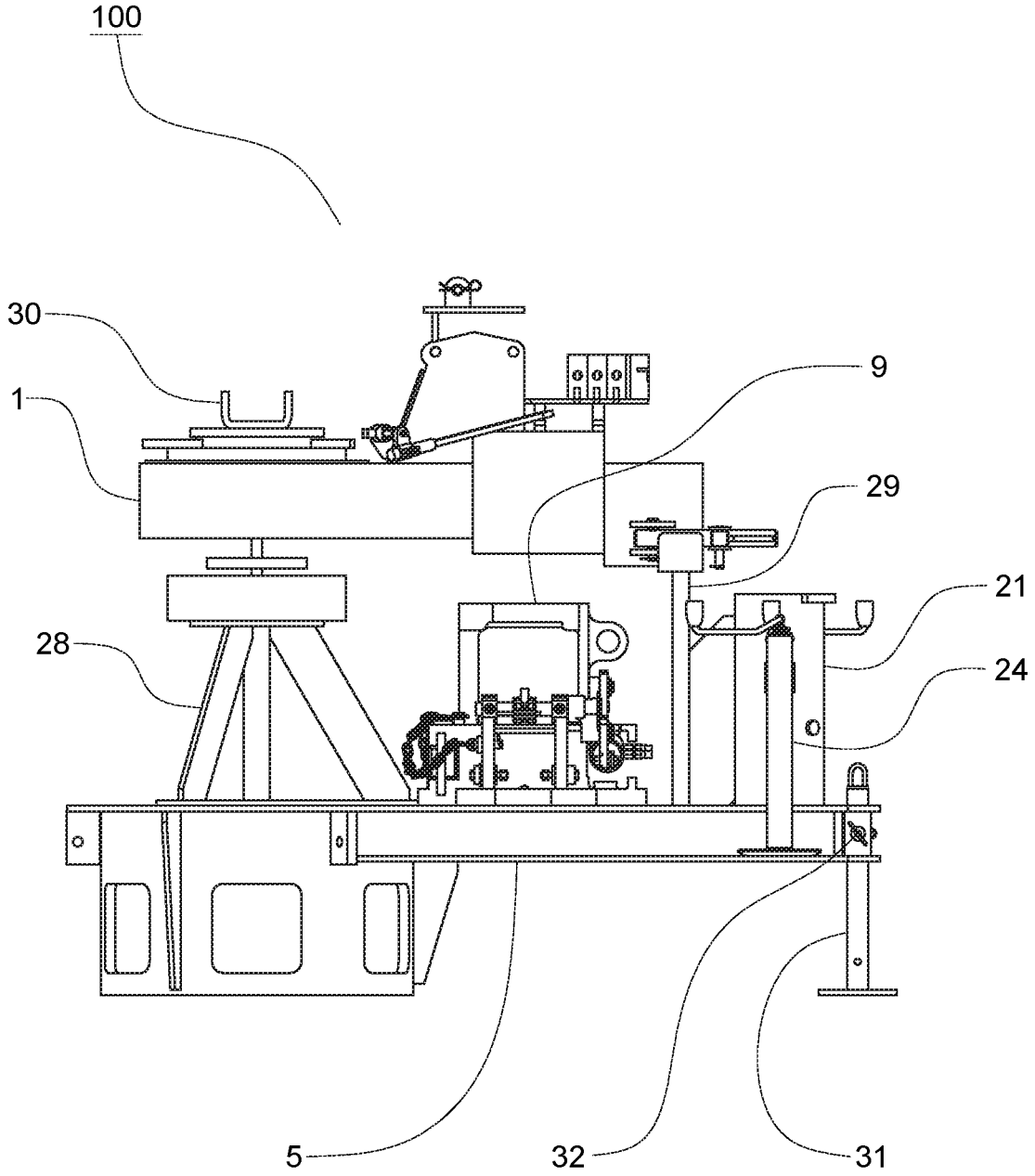
FIG. 4B is a side elevation view depicting the tong and base of the TOPS system of FIG. 1 in transport mode.

FIGS. 4A and 4B show front and side views of one embodiments of tong 1 and mounting base 5 when configured for transport. In some embodiments, tong 1 can be supported by transport adapter 28 and fixed stand 29 that can be integral to mounting base 5. In some embodiments, tong 1 can be clamped to transport adapter 28 with threaded handle 30. In some embodiments, transport stands 31 can be lowered and held in place by pin 32 to make the load sit level while being transported. In some embodiments, mounting base 5 can be used to hold slips 9 to keep them from moving during transport.

Figure 5A:
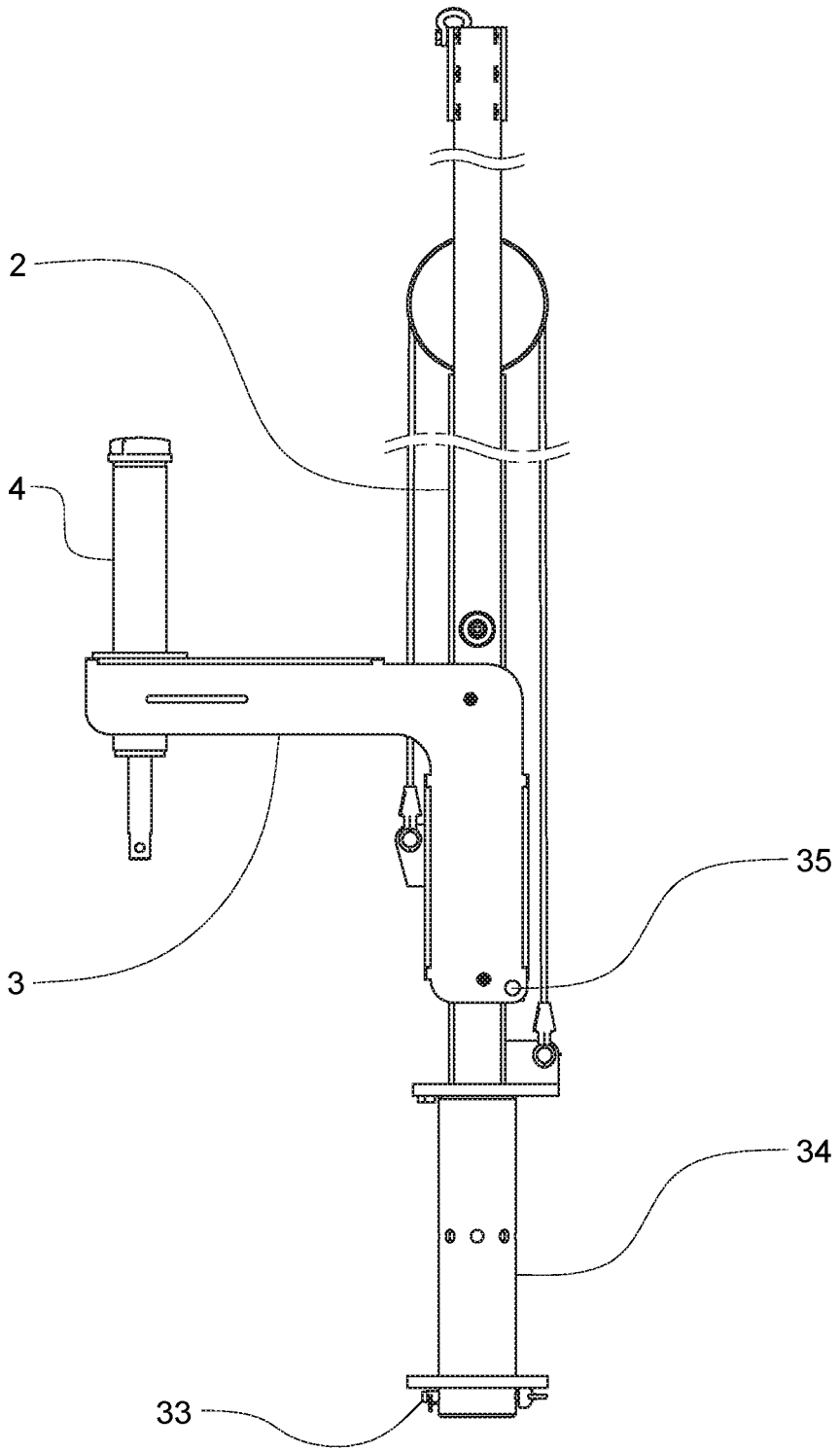
FIG. 5A is a side elevation view depicting the tong hoisting mast of the TOPS system of FIG. 1 in transport mode.
Figure 5B:
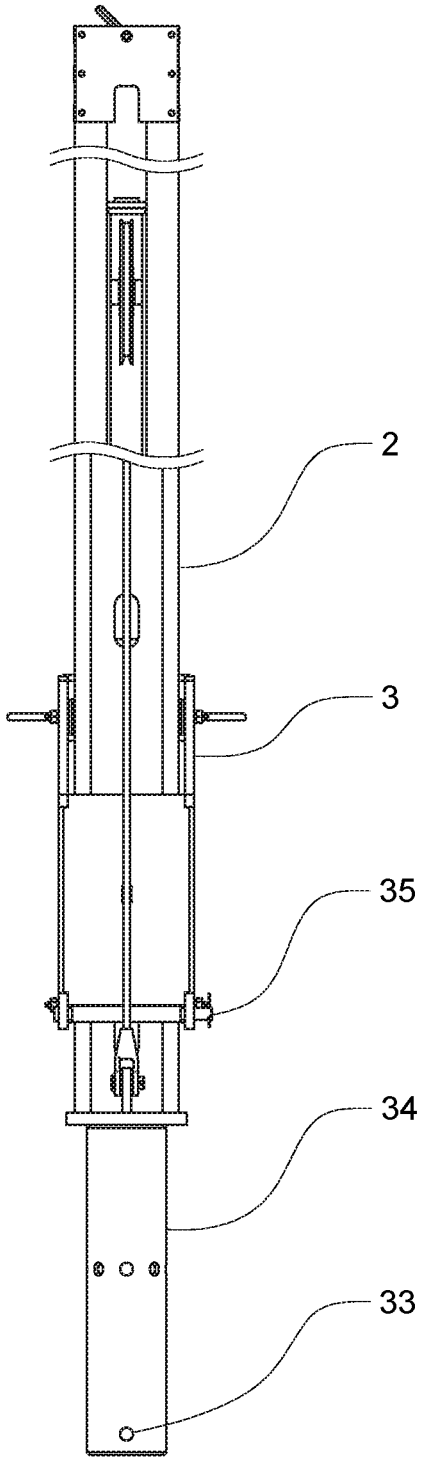
FIG. 5B is a rear elevation view depicting the tong hoisting mast of the TOPS system of FIG. 1 in transport mode.

FIGS. 5A and 5B shows side and rear views of one embodiment of tong hoisting mast 2 when in transport mode. In some embodiments, hoisting mast 2 can be removed from mounting base 5 (not shown) by removing pin 33 and separating cylindrical section 34 of hoisting mast 2 from the housing on the mounting base. In some embodiments, trolley 3 can be immobilized by inserting pin 35 through an opening disposed therethrough.

Figure 6:
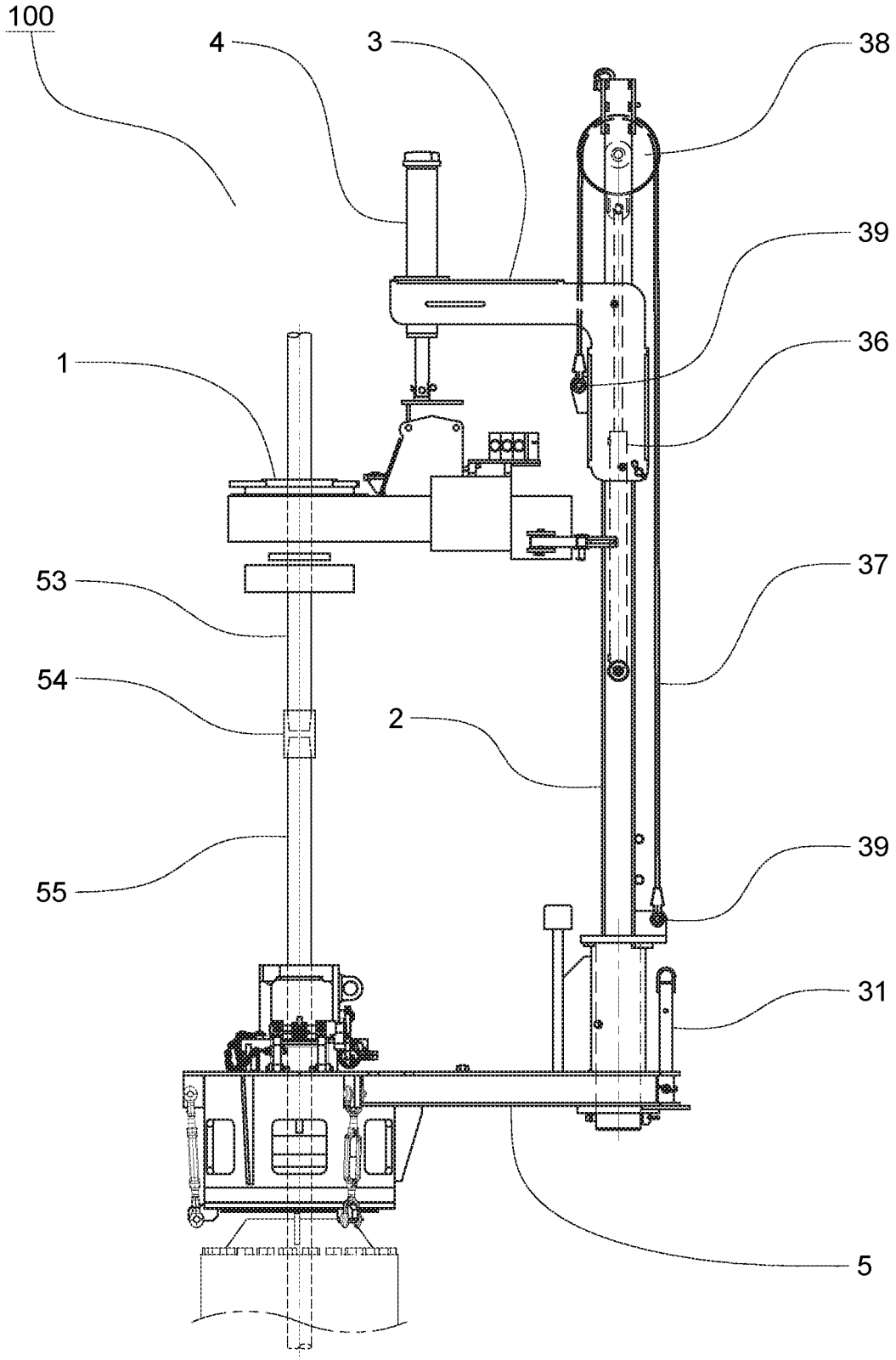
FIG. 6 is a side elevation view depicting one embodiment of the TOPS system of FIG. 1 comprising a hydraulic cylinder and cable sling in the hoisting mast.

FIG. 6 shows a side view of one embodiment of the hoisting mechanism that utilizes linear actuator 36 and cable sling disposed in hoisting mast 2. In some embodiments, linear actuator 36 can support pulley 38 that can be guided between the rails of hoisting mast 2. In some embodiments, cable sling 37 can be anchored at one end to the base of hoisting mast 2 and, at the other end, to movable trolley 3 with pins 39. In some embodiments, movable trolley 3 can move vertically along hoisting mast 2 as linear actuator 36 is extended or retracted. In some embodiments, linear actuator 36 can comprise a hydraulic ram wherein extending or retracting linear actuator 36 can be accomplished by controlling the flow of hydraulic fluid to or from linear actuator 36.

Figure 7:
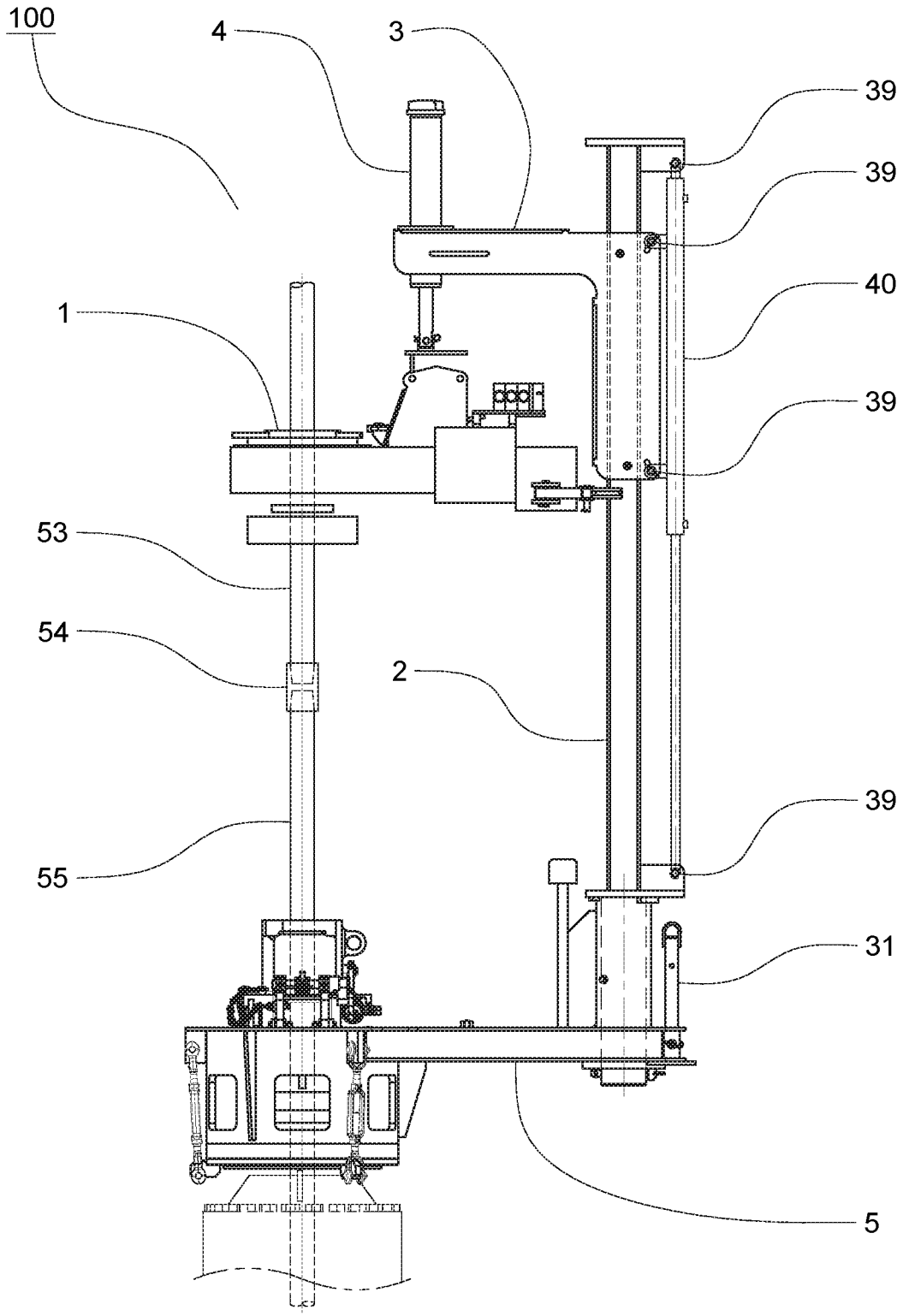
FIG. 7 is a side elevation view depicting a second embodiment of the TOPS system of FIG. 1 comprising a hydraulic cylinder and cable sling in the hoisting mast.

FIG. 7 shows a side view of a second embodiment of the hoisting mechanism that can utilize double-ended linear actuator 40 disposed in hoisting mast 2. In some embodiments, the outer cylinder body of linear actuator 40 can be connected directly to movable trolley 3 with pin 39, with the ends of an inner rod of linear actuator 40 attached to the base and the top or apex of hoisting mast assembly 2 with pins 39. In some embodiments, movable trolley 3 can move vertically along hoisting mast 2 as the cylinder body of linear actuator 40 is moved up or down along the inner rod of linear actuator 40. In some embodiments, linear actuator 40 can comprise a hydraulic mechanism wherein moving linear actuator 40 can be accomplished by controlling the flow of hydraulic fluid to and from linear actuator 40.

Figure 8:
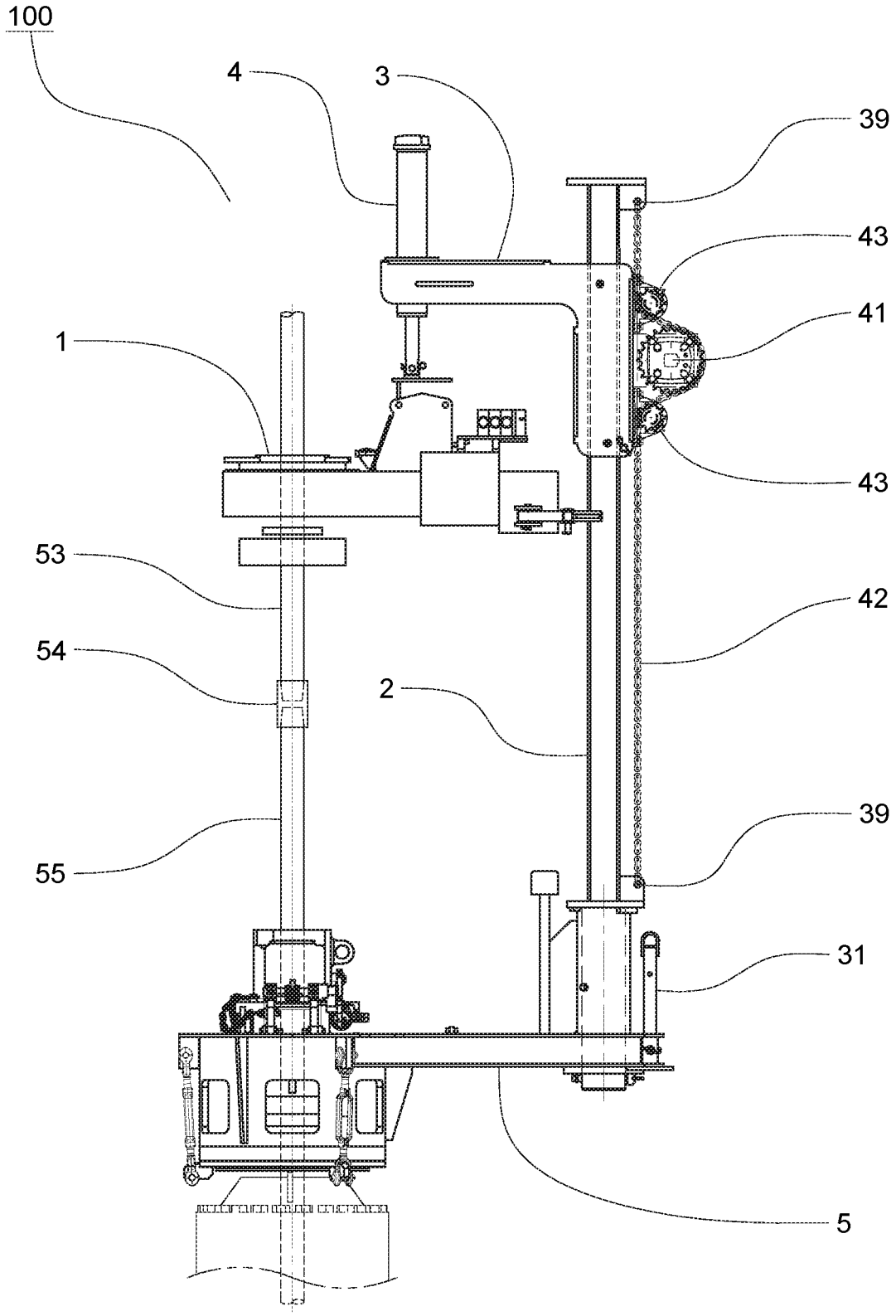
FIG. 8 is a side elevation view depicting a third embodiment of the TOPS system of FIG. 1 comprising a hydraulic motor and roller chain in the hoisting mast.

FIG. 8 shows a side view of a third embodiment of the hoisting mechanism that can utilize motor 41 and roller chain 42 disposed on hoisting mast 2. In some embodiments, roller chain 42 can be attached to the base and the top of hoisting mast 2 with pins 39. In some embodiments, roller chain 42 can be routed around idler sprockets 43 and around a sprocket disposed on motor 41, wherein motor 41 and idler sprockets 43 are mounted on movable trolley 3. As motor 41 rotates, it can cause movable trolley 3 to move vertically up or down along the rails of hoisting mast 2.

Figure 9A:
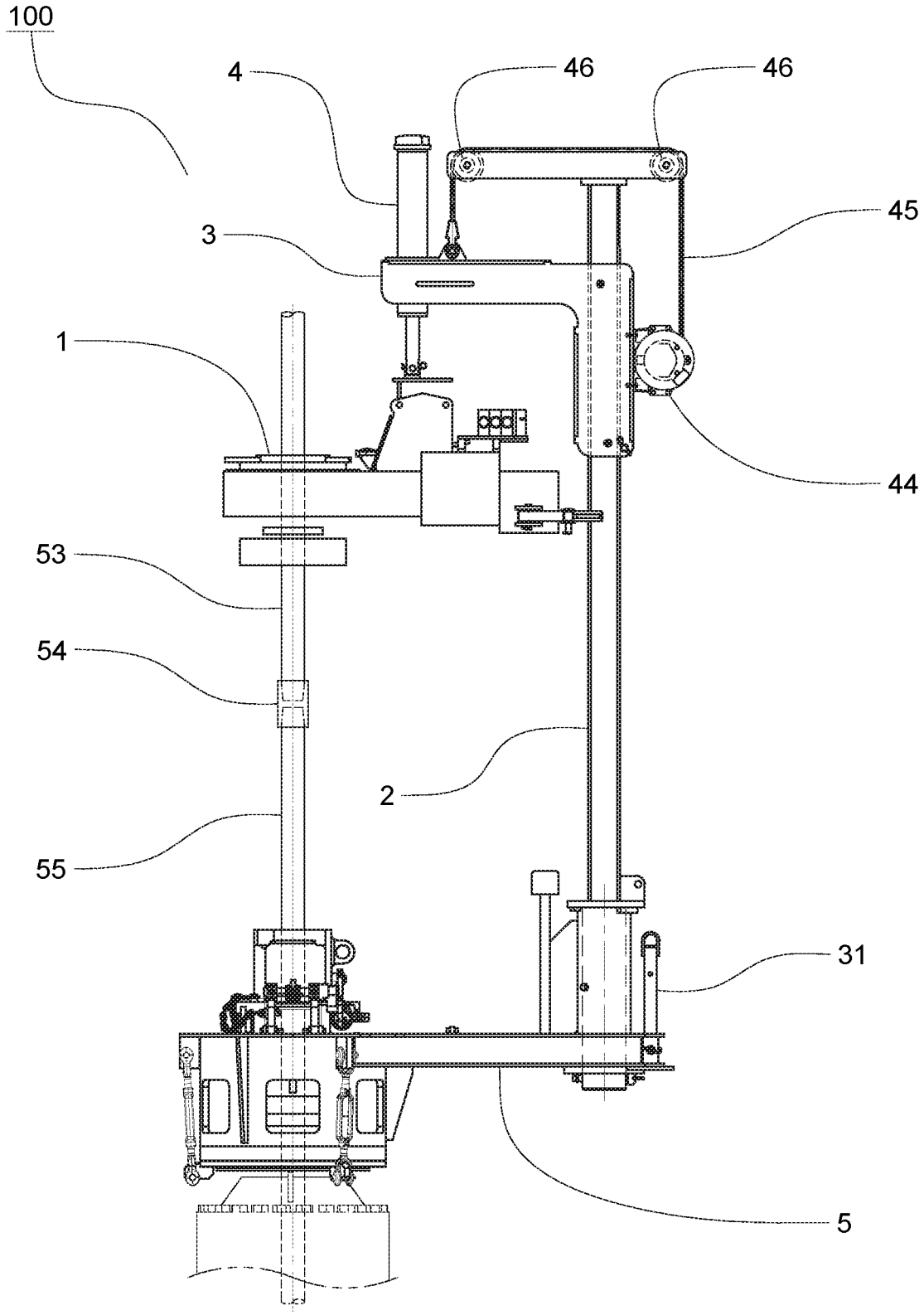
FIG. 9A is an elevation side view depicting a fourth embodiment of the TOPS system of FIG. 1 comprising a hydraulic winch and cable in the hoisting mast.
Figure 9B:
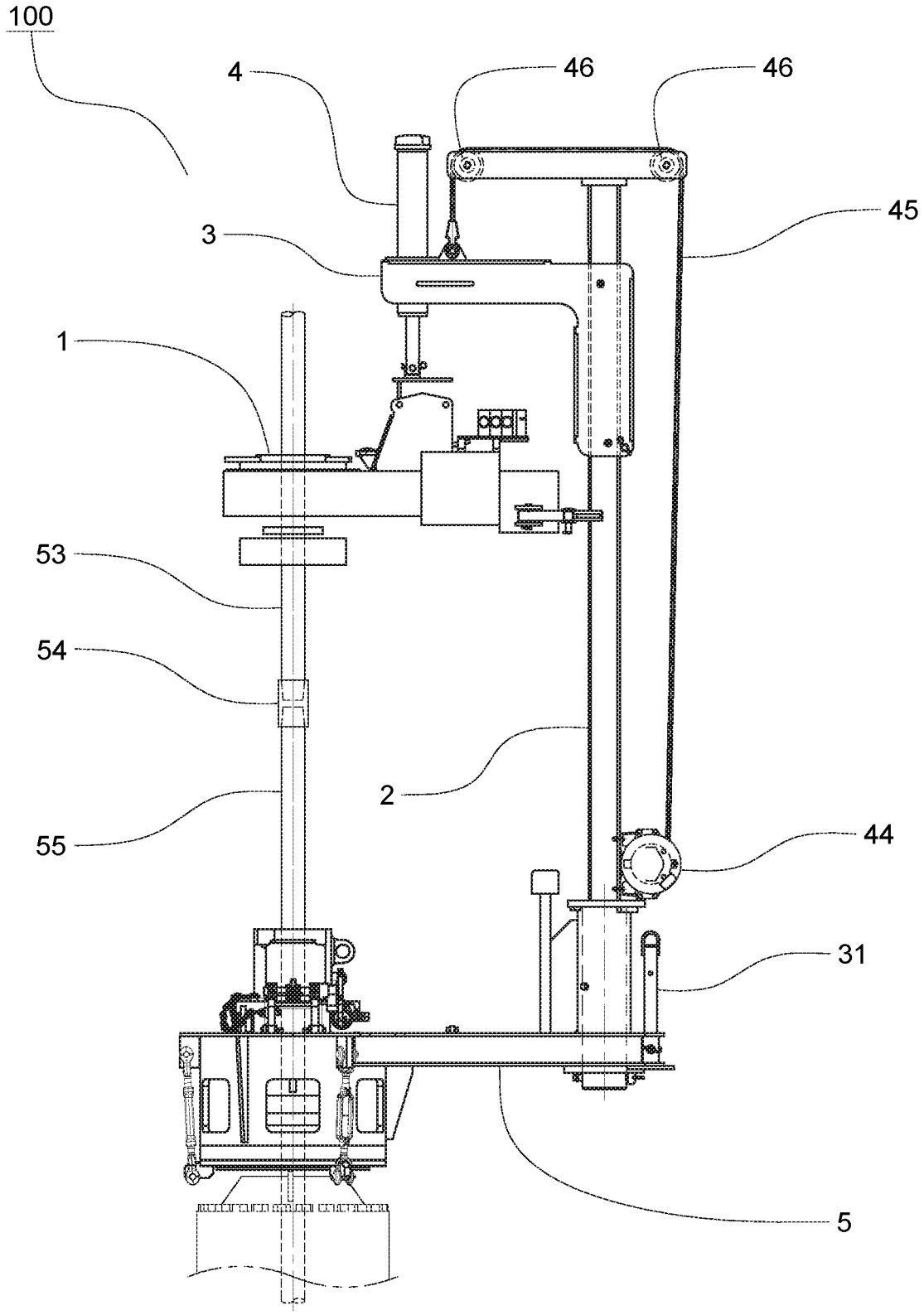
FIG. 9B is an elevation side view depicting a fifth embodiment of the TOPS system of FIG. 1 comprising a hydraulic winch and cable in the hoisting mast.

FIGS. 9A and 9B show a side view of fourth and fifth embodiments of the hoisting mechanism that can utilize winch 44 and cable 45 disposed on hoisting mast 2. In some embodiments, winch 44 can be mounted to movable trolley 3 as shown in FIG. 9A or, alternatively, to the base of hoisting mast 2, as shown in FIG. 9B. In some embodiments, cable 45 can be routed over idler pulleys 46 and attached to movable trolley 3 with pin 39. As cable 45 is reeled in or paid out by winch 44, movable trolley 3 can move vertically up or down along the rails of hoisting mast 2.

Figure 10:
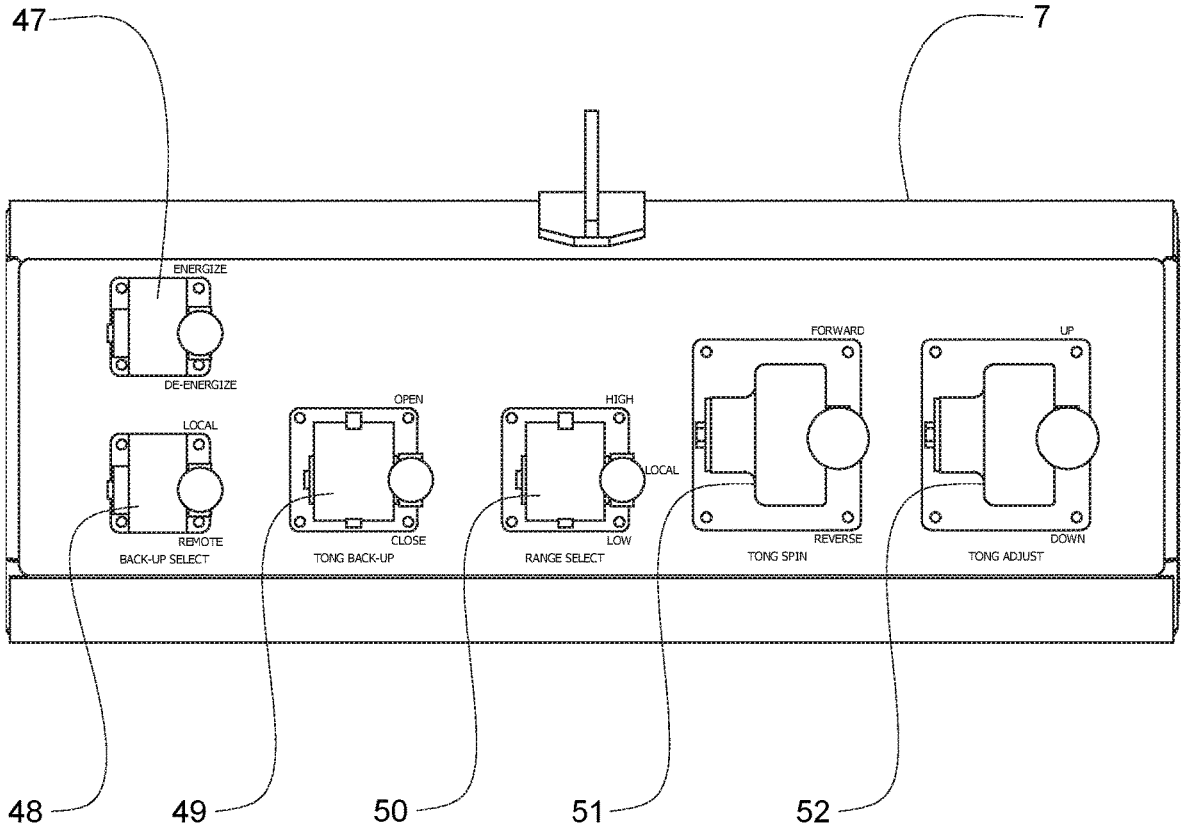
FIG. 10 is a front elevation view depicting one embodiment of a remote-control panel for use with the TOPS system of FIG. 1.

FIG. 10 shows a front view of one embodiment of remote-control panel 7 that can house a circuit and controls that can allow tong 1 to be operated locally or remotely. In some embodiments, control panel 7 can comprise energize control 47 that can be used to energize or de-energize the remote-control system. In some embodiments, control panel 7 can comprise backup select control 48 that can allow the remote operator to control whether the tubing backup will be operated remotely with control panel 7 or locally on tong 1. In some embodiments, control panel 7 can comprise tong backup control 49 that can allow the remote operator to control the tubing backup function of tong 1 remotely from control panel 7. In some embodiments, control panel 7 can comprise three-way range select control 50 that can allow the remote operator to select high range or low range on the transmission of tong 1, or to allow control of the transmission to be locally selected. In some embodiments, control panel 7 can comprise tong spin proportional control 51 that can allow the remote operator to control the speed and direction of the operation of tong 1. In some embodiments, control panel 7 can comprise tong adjust proportional control 52 that can allow the remote operator to control the direction and speed of the vertical movement of TOPS system 100 to move tong 1.

Figure 11A:
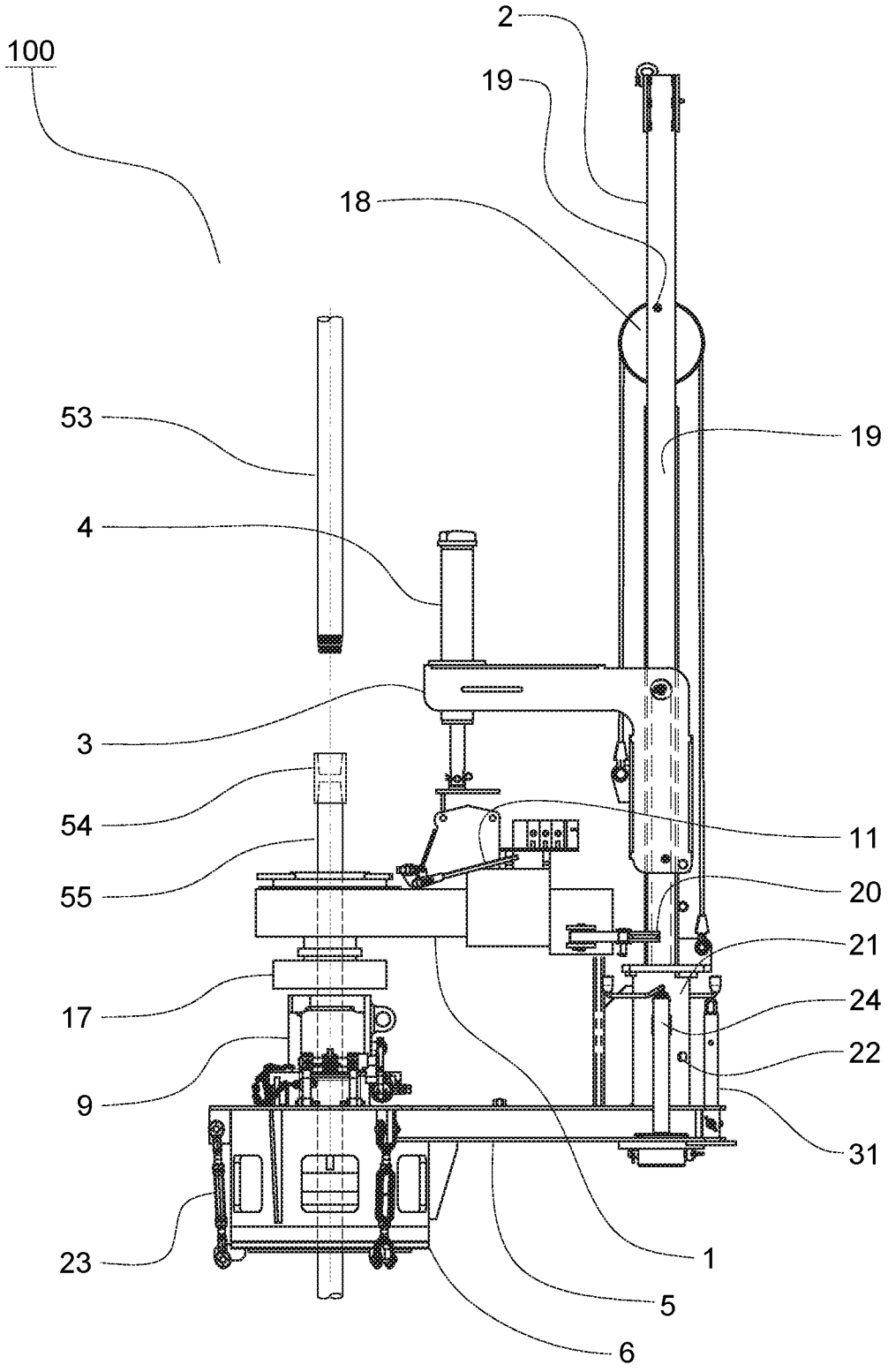
FIG. 11A is an elevation side view depicting the TOPS system of FIG. 1 in the process of adding or removing a joint of tubing.

Referring to FIG. 11A, a side elevation view depicting TOPS system 100 of FIG. 1 is shown in the lowered position to allow the addition or removal of a joint of tubing 53 to or from lower tubing joint 55. In the illustrated embodiment, tong 1 is shown at a lowered position relative to tubing coupler 54 to allow upper tubing 53 to be inserted into, or removed from, tubing coupler 54, as the current operation requires. Lower tubing joint 55 is being held in place and centralized by slips 9.

Figure 11B:
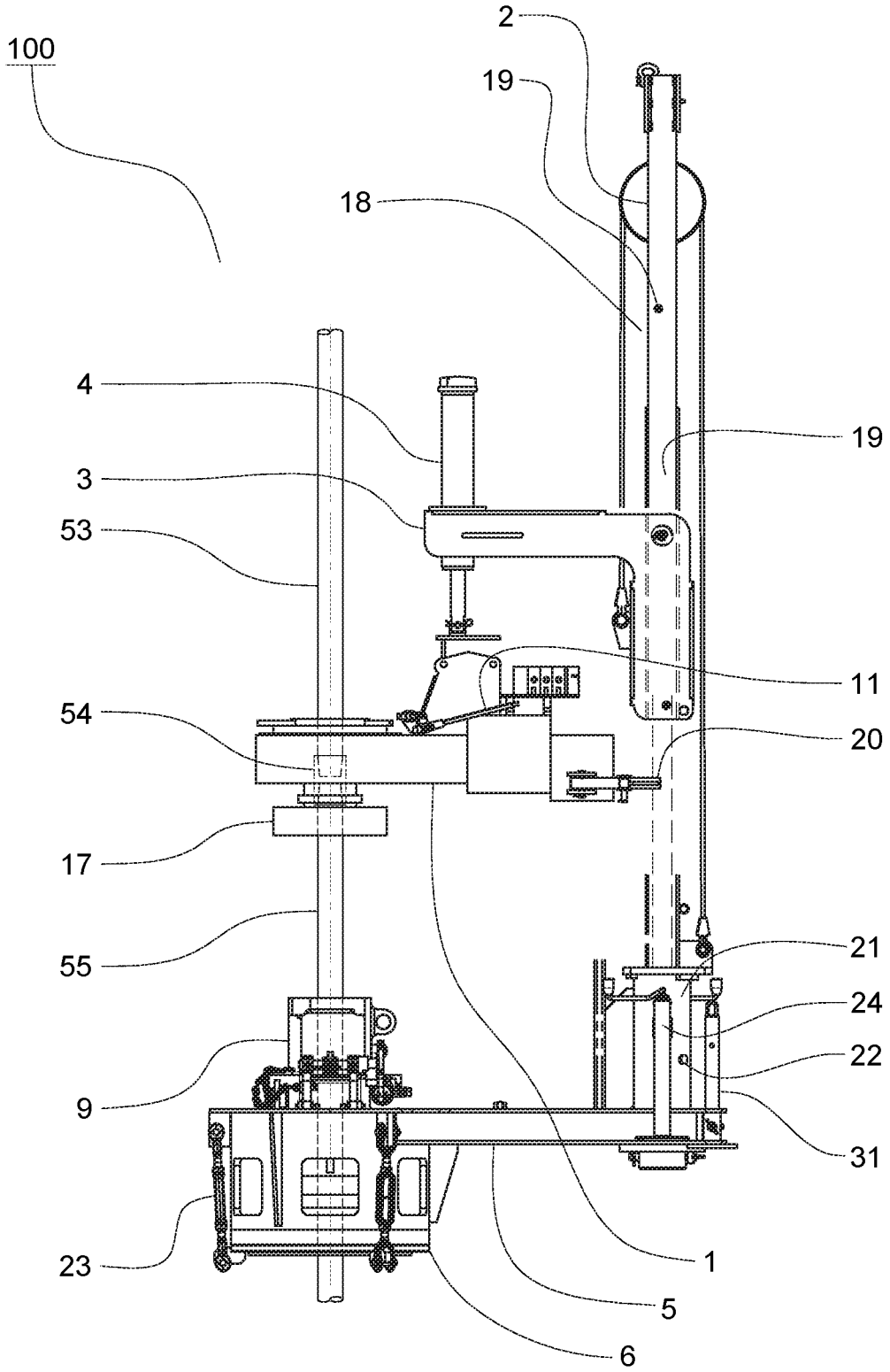
FIG. 11B is an elevation side view depicting the TOPS system of FIG. 1 in the process of making or breaking a joint of tubing.

Referring to FIG. 11B, a side elevation view depicting TOPS system 100 of FIG. 1 is shown in the process of either threading together or unthreading a connection by rotating upper tubing joint 53 in relation to tubing coupler 54. In the illustrated embodiment, tong 1 is shown at a position relative to tubing coupling 54 to allow upper tubing joint 53 to be rotated with tong 1 while lower tubing joint 55 or tubing coupling 54 is held in place by tubing backup 17. Lower tubing joint 55 is being held in place and centralized by slips 9.

The various illustrative logical blocks, modules, circuits, and algorithm steps described in connection with the embodiments disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the embodiments described herein.

Embodiments implemented in computer software may be implemented in software, firmware, middleware, microcode, hardware description languages, or any combination thereof. A code segment or machine-executable instructions may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted via any suitable means including memory sharing, message passing, token passing, network transmission, etc.

The actual software code or specialized control hardware used to implement these systems and methods is not limiting of the embodiments described herein. Thus, the operation and behavior of the systems and methods were described without reference to the specific software code being understood that software and control hardware can be designed to implement the systems and methods based on the description herein.

When implemented in software, the functions may be stored as one or more instructions or code on a non-transitory computer-readable or processor-readable storage medium. The steps of a method or algorithm disclosed herein may be embodied in a processor-executable software module, which may reside on a computer-readable or processor-readable storage medium. A non-transitory computer-readable or processor-readable media includes both computer storage media and tangible storage media that facilitate transfer of a computer program from one place to another. A non-transitory processor-readable storage media may be any available media that may be accessed by a computer. By way of example, and not limitation, such non-transitory processor-readable media may comprise RAM, ROM, EEPROM, CD-ROM or other optical disk storage, magnetic disk storage or other magnetic storage devices, or any other tangible storage medium that may be used to store desired program code in the form of instructions or data structures and that may be accessed by a computer or processor. Disk and disc, as used herein, include compact disc (CD), laser disc, optical disc, digital versatile disc (DVD), floppy disk, and Blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and/or instructions on a non-transitory processor-readable medium and/or computer-readable medium, which may be incorporated into a computer program product.

Although a few embodiments have been shown and described, it will be appreciated by those skilled in the art that various changes and modifications can be made to these embodiments without changing or departing from their scope, intent or functionality. The terms and expressions used in the preceding specification have been used herein as terms of description and not of limitation, and there is no intention in the use of such terms and expressions of excluding equivalents of the features shown and described or portions thereof, it being recognized that the invention is defined and limited only by the claims that follow.

What is claimed is:

1. A system for positioning and operating a tong for inserting a tubing string into a wellbore and removing the tubing string from the wellbore, the wellbore comprising a wellhead disposed on a well servicing rig, the system comprising:

(a) a mounting base configured for mounting on the wellhead disposed on the well servicing rig;

(b) a substantially vertical hoisting mast disposed on the mounting base, the hoisting mast laterally displaced from the wellbore during each of inserting the tubing string into the wellbore and removing the tubing string from the wellbore;

(c) a trolley disposed on the hoisting mast, the trolley configured to move vertically up and down on the hoisting mast, the trolley guided by a plurality of rollers rotatably disposed within rail channels disposed along the hoisting mast;

(d) a tong attachment mechanism disposed on the trolley, the tong attachment mechanism configured to attach the tong to the trolley; and (e) a hoisting mechanism configured for raising and lowering the trolley on the hoisting mast.

2. The system as set forth in claim 1, further comprising a mounting adaptor flange configured for attaching the mounting base to the wellhead.

3. The system as set forth in claim 2, wherein the mounting adaptor flange is configured for attaching the mounting base to a blow-out preventer disposed on the wellhead.

4. The system as set forth in claim 1, wherein the tong attachment mechanism is configured for raising and lowering the tong relative to the trolley when the tong is attached to the tong attachment mechanism.

5. The system as set forth in claim 4, wherein the tong attachment mechanism comprises a spring-loaded mechanism configured for vertical movement of the tong when the tubing string is being threaded together or unthreaded, and then return the tong to a nominal fixed position.

6. The system as set forth in claim 1, wherein the hoisting mechanism comprises:

(a) a linear actuator comprising a first end thereof operatively attached to the hoisting mast and a second end thereof comprising a pulley; and (b) a cable comprising one end thereof operatively attached to a base of the hoisting mast and a second end thereof operatively attached to the trolley, the cable passing over the pulley, wherein extending or retracting the linear attenuator raises or lowers the pulley therein raising or lowering the trolley.

7. The system as set forth in claim 1, further comprising a pivot mechanism configured to move the tong towards and away from a position disposed over the wellbore.

8. The system as set forth in claim 1, further comprising a remote-control panel operatively coupled to the tong, wherein the remote-control panel is configured to transmit control signals to the tong whereby the tong can be operated and positioned from a location remote from the wellbore.

9. The system as set forth in claim 8, wherein the control signals comprises one or more of pneumatically transmitted control signals, hydraulically transmitted control signals, electrically transmitted control signals and wirelessly transmitted radio control signals.

10. A method for positioning and operating a tong for inserting a tubing string into a wellbore, the wellbore comprising a wellhead, the method comprising the steps of:

(a) providing a system as set forth in claim 1;

(b) mounting the system on the wellhead;

(c) lowering a first tubing string through the tong and closing slips to hold the first tubing string in place;

(d) inserting a second tubing string into the first tubing string;

(e) operating the tong to make-up a joint between the first tubing string and the second tubing string; and (f) raising the tubing strings and opening the slips.

11. The method as set forth in claim 10, further comprising the steps of:

(a) raising the joint above the tong;

(b) closing the slips;

(c) aligning the tong with the joint;

(d) operating the tong to break the joint between the first tubing string and the second tubing string; and (e) removing the second tubing string from wellbore.

12. The system as set forth in claim 1, wherein the hoisting mast comprises a single hoisting mast.

13. The system as set forth in claim 6, wherein the linear actuator comprises a single linear actuator.

14. The system as set forth in claim 6, wherein the cable comprises a single cable.

* * * * *